US005667874A

United States Patent [19]

Nakamura et al.

[11] Patent Number: 5,667,874

[45] Date of Patent: Sep. 16, 1997

[54] EMBOSSED TAPE WITH OBLIQUE HOUSING PORTIONS FOR PACKAGING PARTS

[75] Inventors: Keisuke Nakamura; Tomohiko Tamada, both of Tokyo, Japan

[73] Assignee: Japan Aviation Electronics Industry, Ltd., Tokyo, Japan

[21] Appl. No.: 525,002

[22] Filed: Sep. 8, 1995

[30] Foreign Application Priority Data

Sep. 12, 1994 [JP] Japan ..... 6-217401

[51] Int. Cl.[6] ..... B32B 3/12; B65D 85/66

[52] U.S. Cl. ..... 428/178; 428/156; 428/172; 428/906; 206/389; 206/403; 206/538; 242/370

[58] Field of Search ..... 428/178, 156, 428/174, 172, 35.2, 906; 206/389, 403, 538; 242/370

[56] References Cited

U.S. PATENT DOCUMENTS 3,962,508 6/1976 Nakanose ..... 428/169

4,612,230 9/1986 Lilant et al. ..... 428/167

4,781,957 11/1988 Brown et al. ..... 428/43

5,124,191 6/1992 Seksaria ..... 428/178

*Primary Examiner*—Donald Loney

[57] ABSTRACT

A part-packaging embossed tape includes a tape member on which a plurality of part-housing portions are arranged in succession in a longitudinal direction of the tape member. Each of the part-housing portions is arranged obliquely relative to a width direction of the tape member which is orthogonal to the longitudinal direction thereof. Recessed portions are further arranged around the part-housing portions, while maintaining given non-recessed spaces between the adjacent part-housing portions. With this arrangement, the embossed tape can be wound around a reel by bending the non-recessed spaces between the adjacent part-housing portions.

14 Claims, 8 Drawing Sheets

EMBOSSED TAPE WITH OBLIQUE HOUSING PORTIONS FOR PACKAGING PARTS

BACKGROUND OF THE INVENTION

The present invention relates to a packaging unit for packaging a plurality of parts and, more specifically, to a packaging unit in the form of a tape which is suitable for automatically mounting parts, each having a relatively large width, onto an object such as a board.

Various packaging units have been proposed for packaging small parts, such as connectors each having a plurality of contacts. For example, those packaging units using a stick carrier or a tray are known, which will later be described in conjunction with the drawing. However, either of the stick carrier and the tray provides only small space for housing the connectors so that the number of the connectors to be packaged per stick carrier or tray is limited. Further, when using the stick carrier or the tray, a manual operation is required for mounting the connector onto a board. This manual operation requires much time so that the working efficiency is lowered as compared with the automatic mounting of the connector.

Further, there is available a packaging unit which houses the connectors in a tape member thereof. In this packaging unit, it is usual that each connector is packaged in a posture where a width or longitudinal direction of the connector coincides with a width direction of the tape member. However, when the number of the contacts mounted to each connector is increased, a width of each connector, that is, a magnitude of each connector in a longitudinal direction thereof, is increased so that the connector can not be properly received within a width of the tape member.

In this case, it may be considered that each connector is packaged in an inclined posture relative to the tape member. However, when the connector is packaged in the inclined posture, it becomes difficult to wind the tape member around a reel. Accordingly, when the width of the connector exceeds a given range, the connector can not be packaged by means of the tape member. Thus, the connector having such a large width has to be packaged using the foregoing stick carrier or tray.

SUMMARY OF THE INVENTION

Therefore, it is an object of the present invention to provide an improved embossed tape for packaging given parts.

Other objects of this invention will become clear as the description proceeds.

According to an aspect of the present invention, there is provided an embossed tape for packaging parts in succession in a longitudinal direction thereof. The embossed tape comprises a plurality of housing sections arranged in the longitudinal direction. Each of the housing sections comprises a housing portion for housing each of the parts. The housing portion extends in a particular direction which is slanted relative to the longitudinal direction. The embossed tape further comprises a plurality of bendable sections each of which is between adjacent ones of the housing sections to enable the embossed tape to be wound with each of the parts housed in the housing portion.

According to another aspect of the present invention, there is provided an apparatus for packaging parts. The apparatus comprises a reel, and an embossed tape for packaging the parts in succession in a longitudinal direction thereof. The embossed tape is adapted to be wound around the reel with the parts packaged therein. The embossed tape comprises a plurality of housing sections arranged in the longitudinal direction. Each of the housing sections comprises a housing portion for housing each of the parts. The housing portion extends in a particular direction which is slanted relative to the longitudinal direction. The embossed tape further comprises a plurality of bendable sections each of which is between adjacent ones of the housing sections to enable the embossed tape to be wound with each of the parts housed in the housing portion.

According to still another aspect of the present invention, there is provided a part-packaging embossed tape comprising a tape member and a plurality of part-housing portions formed on the tape member in succession in a longitudinal direction of the tape member. Each of the part-housing potions has a housing space for housing a given part. In the part-packaging embossed tape, each of the part-housing portions is arranged obliquely relative to a width direction of the tape member which is orthogonal to the longitudinal direction of the tape member, the tape member being adapted to be wound around a reel with the parts housed in the obliquely-arranged part-housing portions.

DESCRIPTION OF THE PREFERRED EMBODIMENTS

Figure 1:
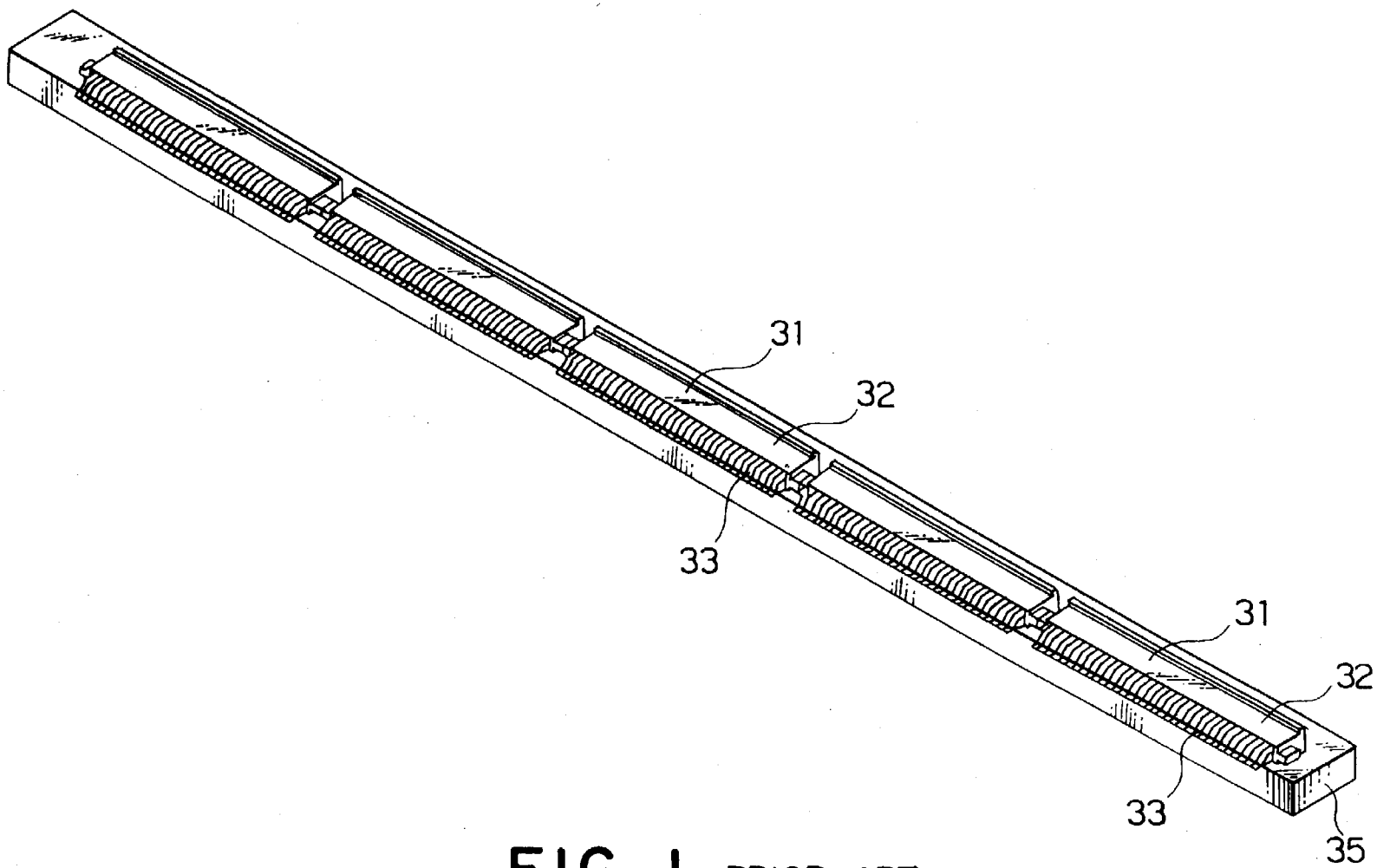
FIG. 1 PRIOR ART
FIG. 1 is a perspective view showing connectors packaged on a conventional stick carrier.

In order to facilitate understanding of the present invention, a conventional packaging unit will be first explained hereinbelow before describing preferred embodiments of the present invention. As shown in FIG. 1, each of connectors 31 includes an insulator 32 and a plurality of conductive contacts 33 incorporated in the insulator 32. The contacts 33 are arranged in parallel with each other at given regular pitches therebetween. A plurality of the connectors 31 are packaged as being placed on a stick carrier 35 of an elongated plate shape.

Figure 2:
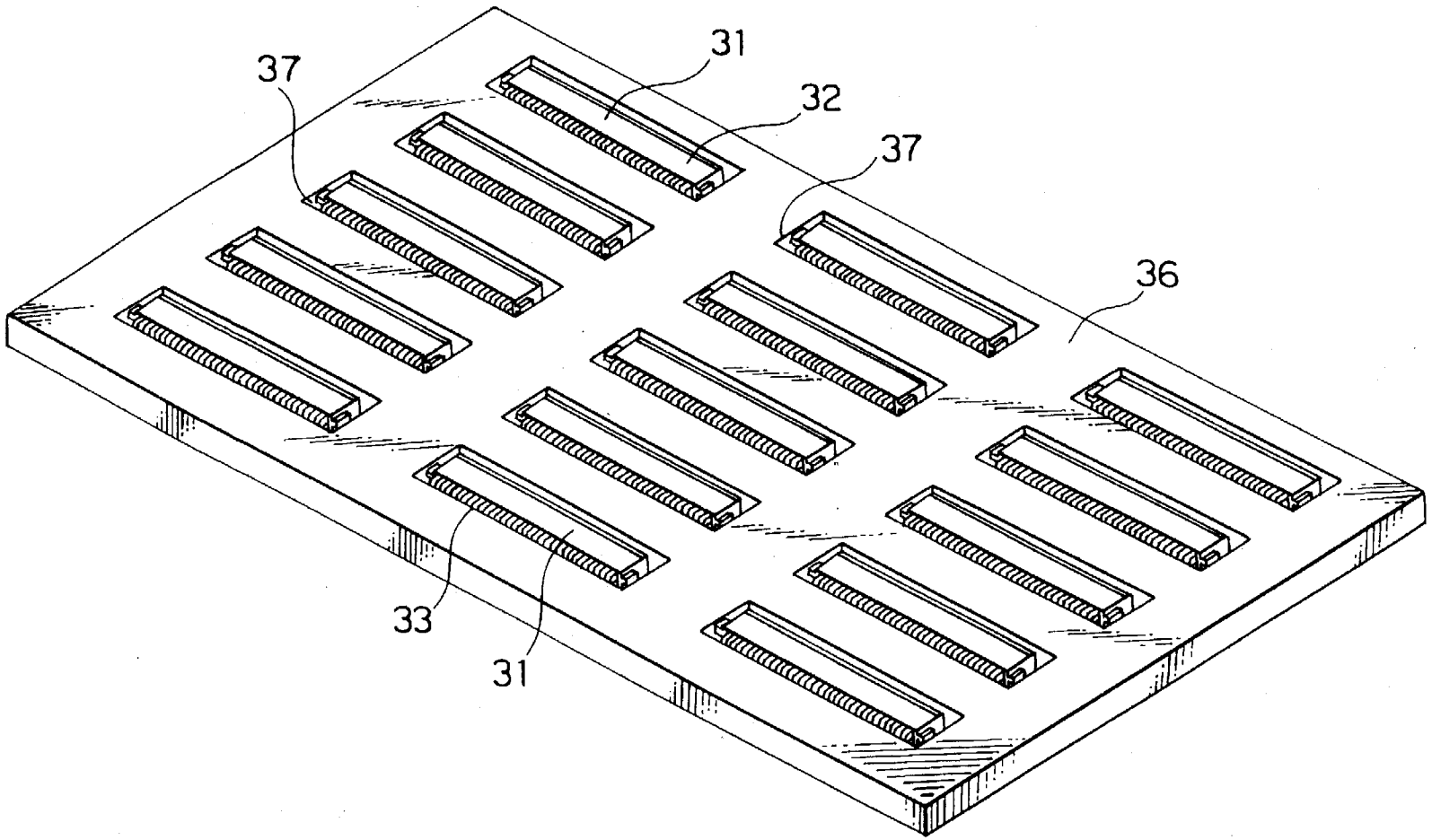
FIG. 2 PRIOR ART
FIG. 2 is a perspective view showing connectors packaged on a conventional tray.
Figure 3:
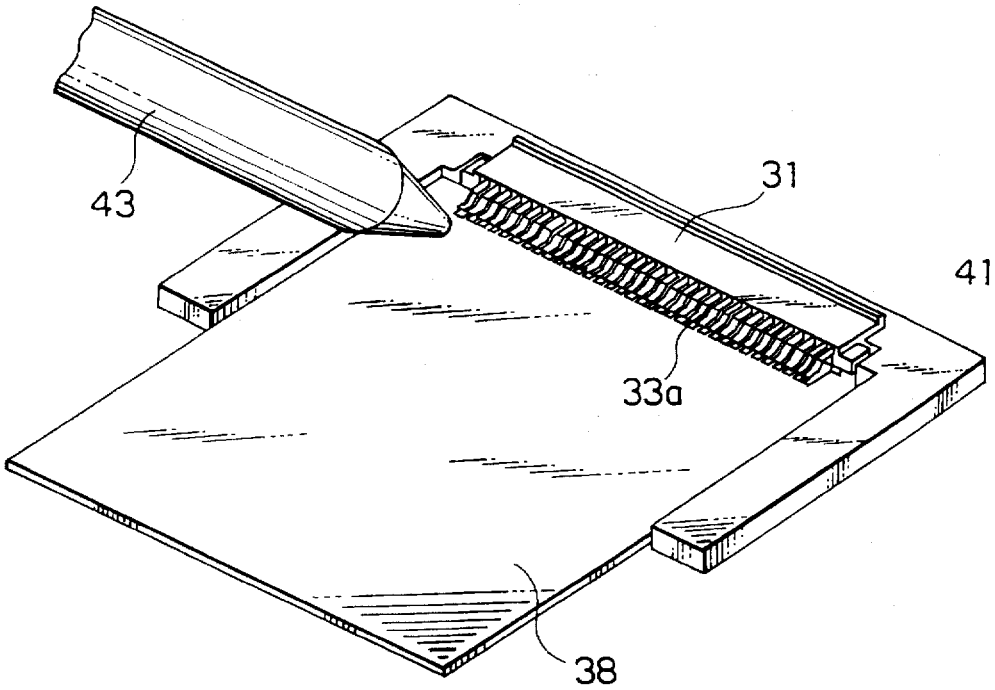
FIG. 3 PRIOR ART
FIG. 3 is a perspective view for explaining a conventional manual operation for mounting a connector on a board.

FIG. 2 shows another example of packaging a plurality of the connectors 31. As shown in FIG. 2, the connectors 31 are housed on a tray 36. Specifically, the tray 36 is formed thereon with a plurality of housing grooves 37 each for receiving one of the connectors 31. The connectors 31 are packaged as being housed in the housing grooves 37 one to one. The connectors 31 housed in the stick carrier 35 or the tray 36 are taken therefrom one by one so as to be mounted on a board 38 as shown in FIG. 3. The connector 31 is then connected to a counterpart connector (not shown) so as to achieve the electrical connection therebetween.

The connector 31 is mounted on the board 38 in the following manner:

A jig 41 having an essentially U-shape in plan is used so as to set the board 38 in an essentially U-shaped frame of the jig 41. Subsequently, the connector 31 is manually put on the board 38. Then, terminals 33*a* of the contacts 33 are soldered to corresponding conductive portions of the board 38 using a soldering iron 43.

However, either of the stick carrier 35 and the tray 36 has only a small space for housing the connectors 31 so that the number of the connectors 31 to be packaged per stick carrier or tray is limited.

On the other hand, there is available a packaging tape which houses the connectors 31 in a tape member thereof. However, in this packaging tape, when the number of the contacts 33 mounted to each of the connectors 31 is increased, a width of each connector 31, that is, a magnitude of each connector 31 in a longitudinal direction thereof, is increased so that the connector 31 can not be properly received within a width of the tape member. On the other hand, when each connector 31 is housed in an inclined posture relative to a width direction of the tape member, the tape member can not specify its bending position other than along each connector 31 in the inclined posture. As a result, when winding the packaging tape around a reel, the tape becomes oblique relative to the reel so that it is difficult to wind the tape around the reel. Accordingly, when the width of the connector 31 exceeds a given range, the connector 31 can not be packaged in the tape member of the packaging tape. Thus, the connector 31 having such a large width has to be packaged using the stick carrier 35 or the tray 36. However, as described above, mounting the connector 31 onto the board 38 requires much time so that the working efficiency is lowered as compared with the automatic mounting of the connector. Now, the preferred embodiments of the present invention will be described hereinbelow.

Figure 4:
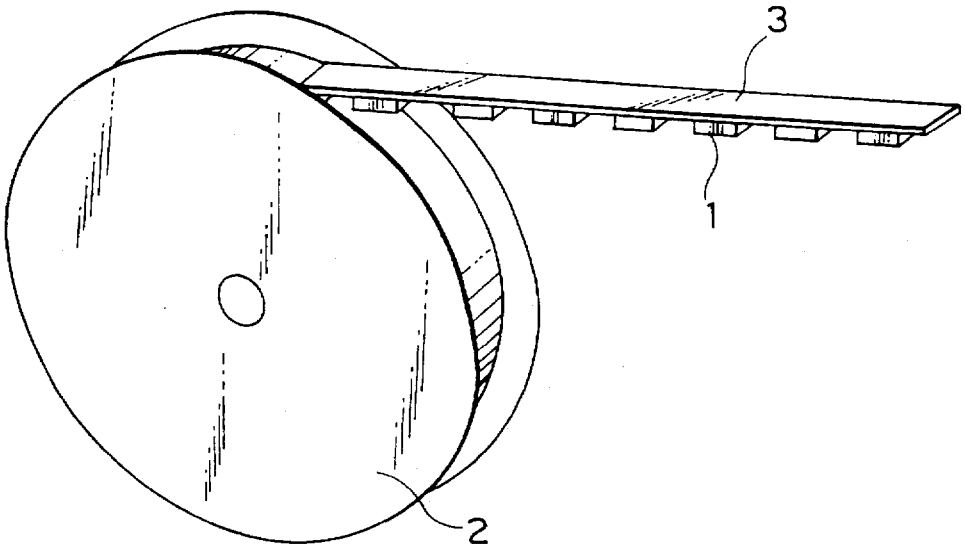
FIG. 4 is a perspective view showing the state where a part-packaging embossed tape with a tape member is wound around a reel.

FIGS. 4 to 8 show an embossed tape according to a first embodiment of the present invention. The embossed tape is for packaging parts such as the connectors and will be called hereunder a part-packaging embossed tape. As shown in FIG. 4, the part-packaging embossed tape includes a tape member 1 and a cover tape 3 attached or bonded to one side of the tape member 1, and is set as being wound around a reel 2. As shown in FIGS. 5 to 8, the tape member 1 is made of plastic material and includes a plurality of part-housing portions 4 in succession in a longitudinal direction of the tape member 1. Each of the part-housing portions 4 includes housing space S for receiving therein one connector 10 (see FIG. 16). Each part-housing portion 4 extends in a particular direction which is slanted relative to a width direction of the tape member 1 which is orthogonal to the longitudinal direction of the tape member 1. These part-housing portions 4 are formed by embossing the tape member 1 in a thickness direction thereof. At both width-direction sides of the tape member 1, a plurality of holes 5 are formed in succession in the longitudinal direction of the tape member 1. These holes 5 are used for moving the tape member 1, that is, the part-packaging embossed tape, in the longitudinal direction by engagement with pins or the like of a drive device (not shown).

The tape member 1 further includes recessed portions 6 which are formed at both sides of each part-housing portion 4, that is, at opposite sides of the tape member 1 in its width direction. The recessed portions 6 are formed by embossing portions of the tape member 1 around the corresponding part-housing portions 4, while maintaining non-embossed spaces between the adjacent part-housing portions 4 which are necessary for bending the tape member 1. Accordingly, the tape member 1 can be wound around the reel 2 by bending the spaces between the adjacent part-housing portions 4. As seen from FIG. 5, the recessed portions 6 and the corresponding part-housing portion 4 intersect with each other and are formed continuous with each other. In this part-packaging embossed tape, each of the recessed portions 6 is adjacent to and connected to each part-housing portion 4 and extends along the tape member 1 in a specific direction which is slanted relative to each of the longitudinal and the particular directions.

Figure 5:
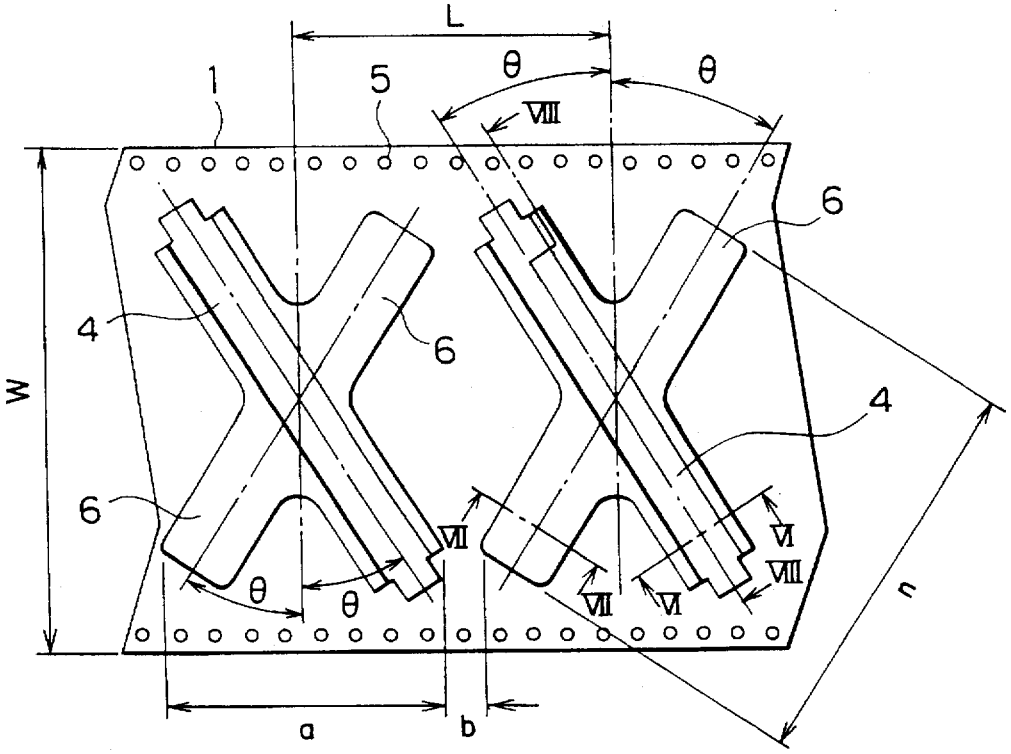
FIG. 5 is a plan view showing a main part of the embossed tape shown in FIG. 4, according to a first preferred embodiment of the present invention.
Figure 6:
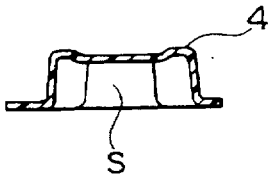
FIG. 6 is a sectional view taken along line VI—VI in FIG. 5.
Figure 7:
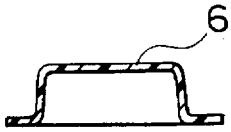
FIG. 7 is a sectional view taken along line VII—VII in FIG. 5.
Figure 8:
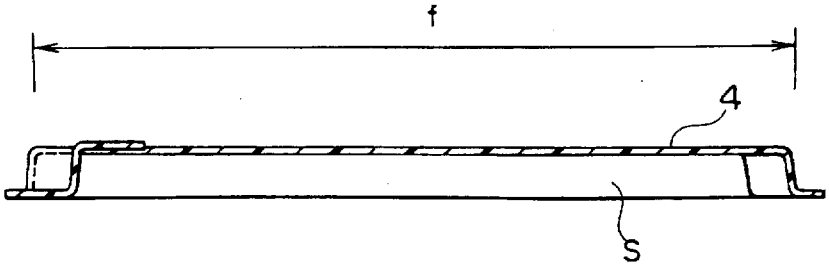
FIG. 8 is a sectional view taken along line VIII—VIII in FIG. 5.

As shown in FIG. 5, the part-housing portion 4 is inclined relative to the width direction of the tape member 1 by a first angle θ (33° in FIG. 5) in a plus-minus direction. The intersecting recessed portions 6 are inclined relative to the width direction of the tape member 1 by a second angle θ (33° in FIG. 5) in a minus-plus direction. Further, a width W of the tape member 1 is set to 56 mm, an interval L between the centers of the adjacent part-housing portions 4 is set to 36 mm, a length f (see FIG. 8) of the part-housing portion 4 is set to 50.5 mm, and a length n of the intersecting recessed portions 6 is set to 44.9 mm.

Since the recessed portions 6 are provided as intersecting the corresponding part-housing portion 4, rigidity of the tape member 1 in a winding direction thereof is enhanced at section a between longitudinal ends of the intersecting recessed portions 6. Accordingly, when winding the tape member 1 around the reel 2, the tape member 1 bends at section b between the adjacent part-housing portions 4, which has less rigidity than the section a. The sections a and b are referred to as a housing section and a bendable section, respectively.

As appreciated, if no recessed portions 6 are provided, since the tape member 1 can not specify the bending positions other than the obliquely arranged connectors and part-housing portions, the part-packaging embossed tape becomes oblique relative to the reel when winding the packaging tape around the reel, so that it is difficult to wind the tape around the reel.

Figure 9:
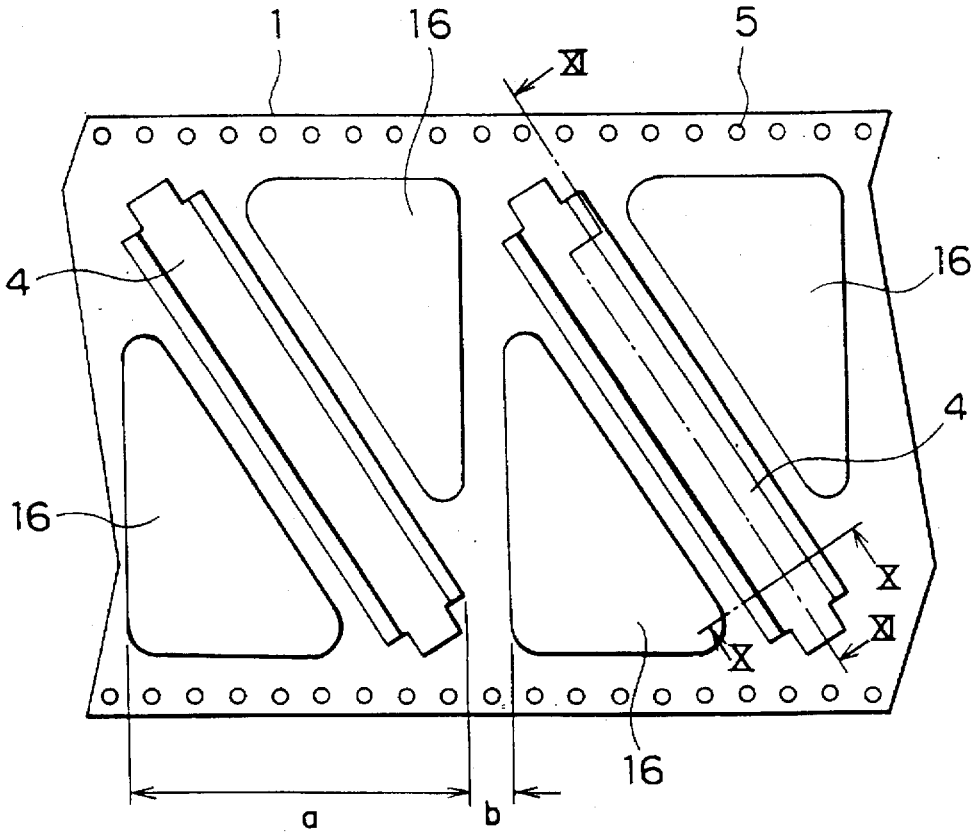
FIG. 9 is a plan view showing a main part of the embossed tape shown in FIG. 4, according to a second preferred embodiment of the present invention.
Figure 10:
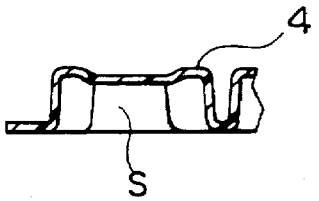
FIG. 10 is a sectional view taken along line X—X in FIG. 9.
Figure 11:
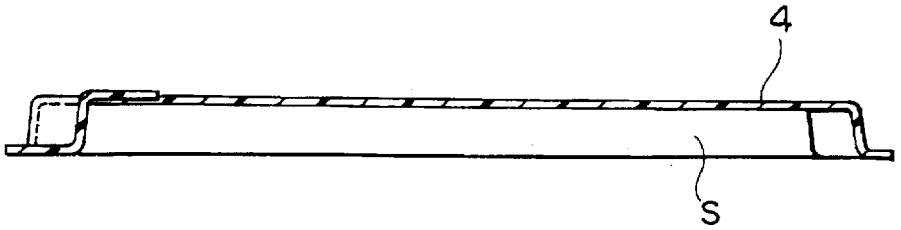
FIG. 11 is a sectional view taken along line XI—XI in FIG. 9.

FIGS. 9 to 11 show a part-packaging embossed tape according to a second embodiment of the present invention. In these figures, the same or like components are represented by the same reference numerals as those in FIGS. 5 to 8. In this embodiment, recessed portions 16 of the embossed tape differ in position and shape from the recessed portions 6 of the embossed tape in the foregoing first preferred embodiment. More particularly, each of the recessed portions 16 extends along each part-housing portion 4 in the particular direction and further extends in the specific direction to make a triangle shape in a plan view. The other structure is essentially the same as that in the first preferred embodiment.

The recessed portions 16, each having a triangular shape in plan, are formed at opposite sides of the tape member i in its width direction so as to sandwich the part-housing portion 4 from its both sides.

Since the recessed portions 16 and the corresponding part-housing portion 4 are provided, rigidity of the tape member 1 in a winding direction thereof is enhanced at section a between respective ends of the recessed portions 16. Accordingly, when winding the tape member 1 around the reel 2, the tape member 1 bends at section b between the adjacent part-housing portions 4, which has less rigidity than the section a.

FIGS. 12 to 15 show a part-packaging embossed tape according to a third embodiment of the present invention. In these figures, the same or like components are represented by the same reference numerals as those in FIGS. 5 to 8. In this part-packaging embossed tape, recessed portions 26 of the embossed tape differ in position and shape from the recessed portions 6 of the embossed tape in the foregoing first preferred embodiment. The other structure is essentially the same as that in the first preferred embodiment.

Figure 12:
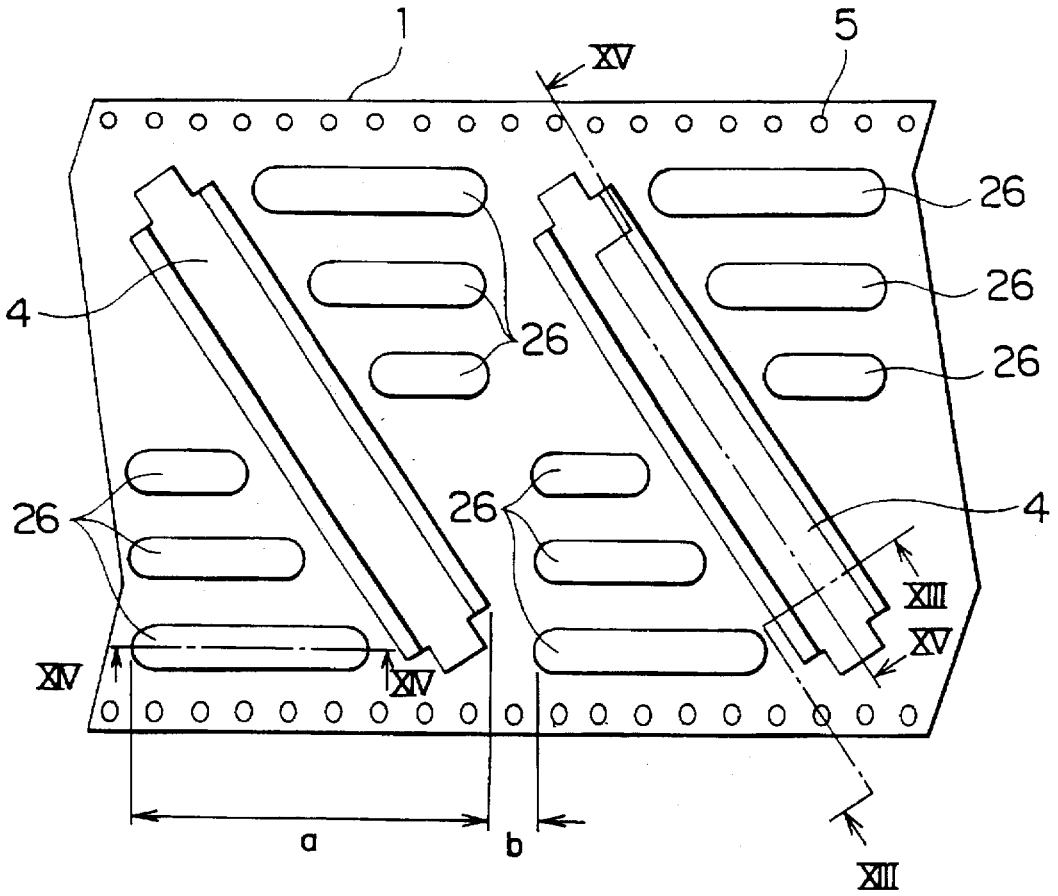
FIG. 12 is a plan view showing a main part of the embossed tape shown in FIG. 4, according to a third preferred embodiment of the present invention.
Figure 13:
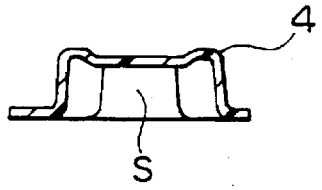
FIG. 13 is a sectional view taken along line XIII—XIII in FIG. 12.
Figure 14:
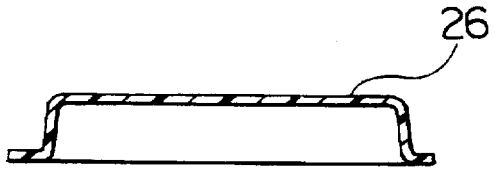
FIG. 14 is a sectional view taken along line XIV—XIV in FIG. 12.
Figure 15:
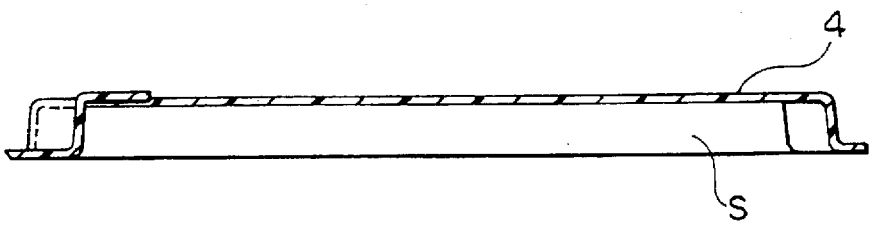
FIG. 15 is a sectional view taken along line XV—XV in FIG. 12.

The recessed portions 26 are formed at opposite sides of the tape member 1 in its width direction so as to sandwich the part-housing portion 4 from its both sides. As seen in FIG. 12, three recessed portions 26 are formed at each side of the tape member 1 or the part-housing portion 4. As also seen in FIG. 12, lengths of the three recessed portions 26 increase from the center of the part-housing portion 4 toward the longitudinal end thereof.

Since the recessed portions 26 and the corresponding part-housing portion 4 are provided, rigidity of the tape member 1 in a winding direction thereof is enhanced at section a between respective ends of the recessed portions 26. Accordingly, when winding the tape member 1 around the reel 2, the tape member 1 bends at section b between the adjacent part-housing portions 4, which has less rigidity than the section a.

Figure 16:
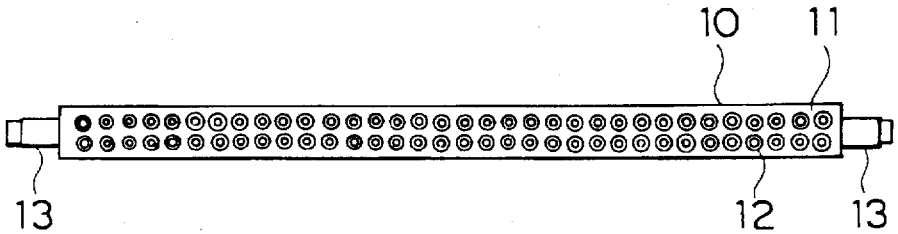
FIG. 16 is a front view showing a connector to be housed in the embossed tape of the first, second or third preferred embodiment.
Figure 17:
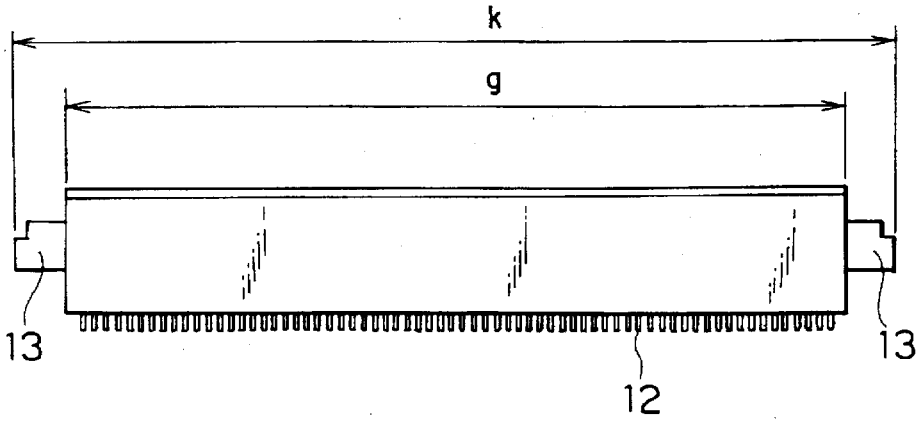
FIG. 17 is a plan view of the connector shown in FIG. 16.
Figure 18:
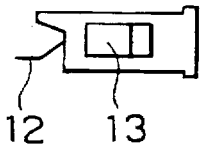
FIG. 18 is a side view of the connector shown in FIG. 16.

FIGS. 16 to 18 show the connector 10 to be housed in the part-housing portion 4 in the foregoing first to third preferred embodiments. Each part-housing portion 4 houses one connector 10. The connector 10 includes an insulator 11 and a plurality of conductive contacts 12 incorporated in the insulator 11. The contacts 12 are arranged in two rows and in parallel with each other at given regular pitches therebetween. The insulator 11 has flanges 13 at both longitudinal ends thereof, respectively.

Since the length f (see FIG. 8) of the part-housing portion 4 is set to 50.5 mm as described before, a width or longitudinal magnitude g of the connector 10 is set to 44.45 mm. As appreciated, since a longitudinal magnitude k includes lengths of the flanges 13, k>g. The connector 10 is inserted into each of the part-housing portions 4 so as to be arranged obliquely relative to the width direction of the tape member 1 and packaged.

Figure 19:
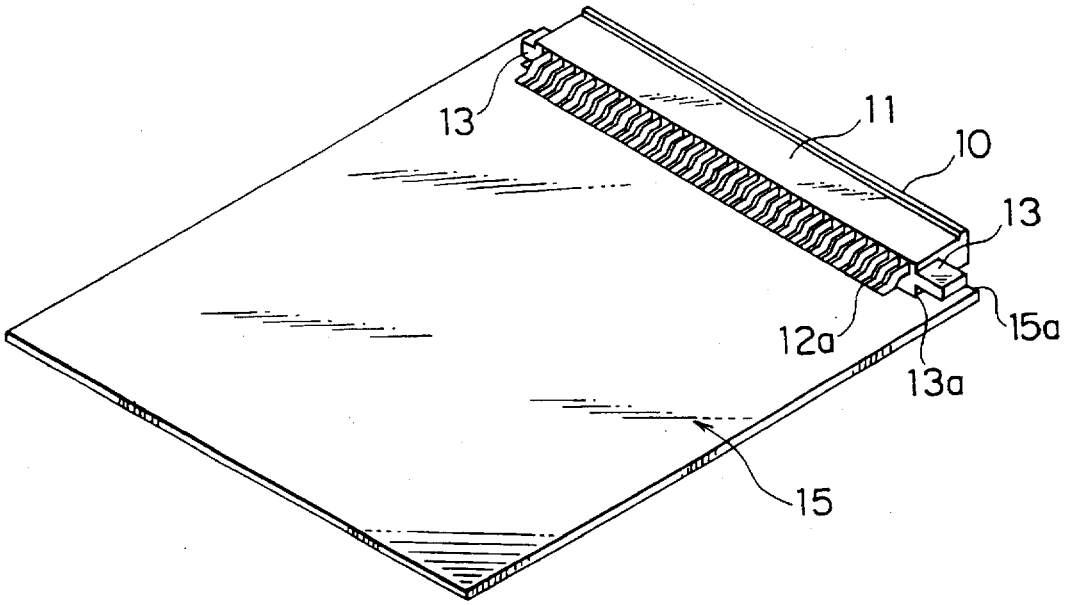
FIG. 19 is a perspective view showing the state where the connector taken from the embossed tape of the first, second or third preferred embodiment is mounted on a board.
Figure 20:
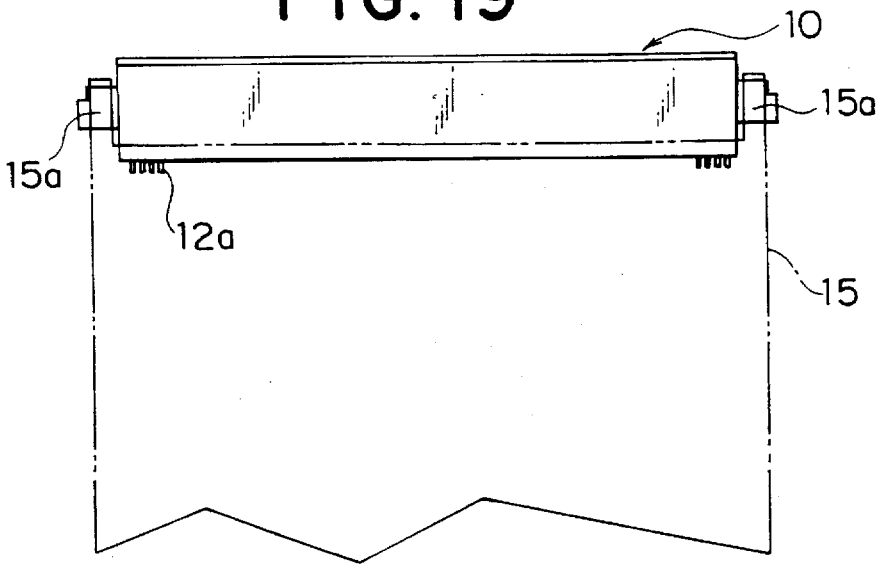
FIG. 20 is a plan view of the connector and the board shown in FIG. 19.
Figure 21:
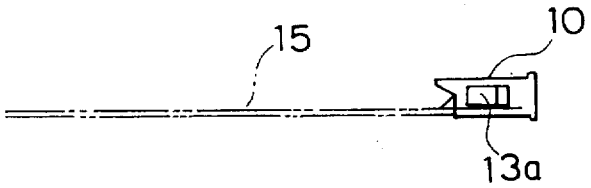
FIG. 21 is a side view of the connector and the board shown in FIG. 19.

Now, a method of mounting the connector 10 onto the board will be described with reference to FIGS. 19 to 21.

The board 15 includes a pair of projections 15*a* which are formed by cutting out a portion of one of its rims. A distance between the projections 15*a* is set essentially equal to a width between stepped portions 13*a* each formed at the flange 13 of the connector 10.

The connector 10 is automatically mounted onto the board 15 in the following manner.

One of the connectors 10 wound around the reel 2 is sucked at its one side by a suction device. While sucked, the connector 10 is carried to a position between the projections 15*a* of the board 15 by means of a robot hand or the like connected to the suction device. Further, after positioning the flanges 13 of the connector relative to the projections 15*a* of the board 15, terminals 12*a* of the contacts 12 are soldered to respectively confronting conductive portions of the board 15. As described before, in the foregoing preferred embodiments, the part-packaging embossed tape houses the part, having a relatively large width, obliquely using the tape member. The tape member is formed with the part-housing portions and the corresponding recessed portions. These portions enhance rigidity of the tape member in the winding direction thereof at the corresponding sections so that the tape member is liable to bend at the non-recessed portions between the adjacent part-housing portions. Accordingly, the part-packaging embossed tape with the obliquely arranged parts can be wound around the reel so that the parts can be properly packaged. Even in case a width of each of the parts is larger than that of the tape member, those parts can be properly housed in the tape member and packaged.

While the present invention has been described in terms of the preferred embodiments, the invention is not to be limited thereto, but can be embodied in various ways without departing from the principle of the invention as defined in the appended claims. For example, the bendable section may be narrow to form a substantial line between the housing sections.

What is claimed is:

1. A flexible, elongated packaging unit extending in a longitudinal direction for packaging parts carried by said packaging unit in an intermittent succession in said longitudinal direction, said packaging unit comprising:

a plurality of separate housing sections formed in said packaging unit and arranged in said longitudinal direction, each of said housing sections comprising a housing portion defining a slender housing space for housing each of said parts, said housing space extending in a particular direction which is slanted relative to said longitudinal direction of said packaging unit; and a plurality of bendable sections in said packaging unit each of said bendable sections being positioned between adjacent ones of said housing sections to enable said packaging unit to be wound with each of said parts housed in said housing space.

2. A packaging unit as claimed in claim 1, wherein each of said housing sections further comprises a recessed portion adjacent to said housing portion for providing an increased rigidity of said housing section as compared to a rigidity of said bendable sections.

3. A packaging unit as claimed in claim 2, wherein said recessed portion extends in a specific direction which is slanted relative to each of said longitudinal and said particular directions.

4. A packaging unit as claimed in claim 3, wherein said recessed portion is connected to said housing portion.

5. A packaging unit as claimed in claim 2, wherein said recessed portion extends along said housing portion in said particular direction.

6. A packaging unit as claimed in claim 5, wherein said recessed portion further extends in a specific direction which is slanted relative to each of said longitudinal and said particular directions.

7. A packaging unit as claimed in claim 2, wherein said recessed portion extends in said longitudinal direction.

8. A packaging unit as claimed in claim 2, wherein each of said housing sections further comprises an additional recessed portion adjacent to said housing portion for providing an increased rigidity of said housing section as compared to a rigidity of said bendable sections, said additional recessed portion providing said increased rigidity in cooperation with the first-mentioned recessed portion.

9. An apparatus for packaging parts, comprising:

a reel; and a flexible elongated packaging unit mounted on said reel, said packaging unit extending in a longitudinal direction for packaging said parts in an intermittent succession in said longitudinal direction, said packaging unit being adapted to be wound around said reel with said parts packaged therein, said packaging unit comprising:

a plurality of housing sections in said packaging unit for conveying parts, said housing sections being separately arranged in said longitudinal direction, each of said housing sections comprising a housing portion defining a slender housing space for housing each of said parts, said housing space extending in a particular direction which is slanted relative to said longitudinal direction; and a plurality of bendable sections in said packaging unit, each of said bendable sections being positioned between adjacent ones of said housing sections to enable said packaging unit to be wound in a coil with each of said parts housed in said housing space.

10. A part-packaging unit for packaging given parts comprising:

a tape member; and a plurality of part-housing portions formed on said tape member in an intermittent succession along a longitudinal direction of said tape member, each of said part-housing portions having a housing space for individually housing said given parts, wherein said housing spaces slenderly extend obliquely relative to the longitudinal direction of said tape member, and wherein said tape member is adapted to be wound around a reel with said given parts housed in said obliquely-arranged housing space.

11. A part-packaging unit as claimed in claim 10, wherein recessed portions are provided on said tape member around each of said part-housing portions, said recessed portions being arranged in such a manner as to maintain given non-recessed spaces between said adjacent part-housing portions.

12. A part-packaging unit as claimed in claim 10, wherein recessed portions are arranged at opposite sides of said tape member in said width direction so as to confront each of said part-housing portions, and wherein said tape member is adapted to be wound around the reel by bending in non-recessed spaces between said adjacent part-housing portions.

13. A part-packaging unit as claimed in claim 10, wherein recessed portions are provided on said tape member so as to intersect with each of said part-housing portions, wherein said intersecting recessed portions and part-housing portion are formed continuously with respect to each other, and wherein given non-recessed spaces are maintained between said adjacent part-housing portions.

14. A part-packaging unit as claimed in claim 11, wherein said recessed portions are arranged so as to intersect with the corresponding part-housing portion, and wherein said recessed portions and said corresponding part-housing portion are formed continuous with each other.

* * * * *

UNITED STATES PATENT AND TRADEMARK OFFICE

CERTIFICATE OF CORRECTION

PATENT NO. : 5,667,874
DATED : September 16, 1997
INVENTOR(S) : Keisuke Nakamura and Tomohiko Tamada It is certified that error appears in the above-indentified patent and that said Letters Patent is hereby corrected as shown below:

Column 5, Line 18, delete "tape member i" and insert --tape member 1--.

Signed and Sealed this

Seventeenth Day of February, 1998

Bruce Lehman

*Attest:*

BRUCE LEHMAN

*Attesting Officer*

*Commissioner of Patents and Trademarks*